US006357355B1

(12) United States Patent
Fogle, Jr.

(10) Patent No.: US 6,357,355 B1
(45) Date of Patent: Mar. 19, 2002

(54) PYROTECHNIC IGNITER WITH RADIO FREQUENCY FILTER

(75) Inventor: Homer W. Fogle, Jr., Mesa, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/501,946

(22) Filed: Feb. 10, 2000

(51) Int. Cl.[7] ..... F42B 3/18

(52) U.S. Cl. ..... 102/202.2; 102/202.2; 102/202.7; 102/202.9

(58) Field of Search ..... 102/202.2, 202.4, 102/202.7, 202.9

(56) References Cited

U.S. PATENT DOCUMENTS

| | | | | |
|---|---|---|---|---|
| 3,264,989 A | * | 8/1966 | Rucker | 102/202.4 |
| 5,140,906 A | | 8/1992 | Little, II | |
| 5,367,956 A | | 11/1994 | Fogle, Jr. | |
| 5,403,036 A | | 4/1995 | Zakula et al. | |
| 5,576,509 A | * | 11/1996 | Refouvelet et al. | 102/202.7 |
| 5,621,183 A | | 4/1997 | Bailey | |
| 5,639,986 A | * | 6/1997 | Evans | 102/202.2 |
| 5,691,498 A | | 11/1997 | Fogle, Jr. | |
| 5,847,309 A | * | 12/1998 | Baginski | 102/202.2 |
| 5,932,832 A | * | 8/1999 | Hansen et al. | 102/202.4 |
| 5,988,069 A | * | 11/1999 | Bailey | 102/202.9 |

* cited by examiner

*Primary Examiner*—Michael J. Carone
*Assistant Examiner*—Lulit Semunegus
(74) *Attorney, Agent, or Firm*—Tarolli, Sundheim, Covell, Tummino & Szabo L.L.P.

(57) ABSTRACT

A pyrotechnic device comprises a body of ignitable material (66). A pair of electrodes (44) and (52) provide electrical energy to heat and ignite the body of pyrotechnic material (66). The electrodes (44) and (52) extend through an electrical insulation housing (78). The electrical insulation housing (78) has surfaces defining a chamber (92) through which the electrodes (44) and (52) pass. A body (94) of a solid electromagnetically lossy, substantially gas impermeable material is positioned within the chamber (92). The lossy material comprises a vitreous ceramic matrix consisting essentially of about 5% to about 50% by weight of a multi-component glass binder and about 50% to about 95% by weight of an electromagnetically lossy ferromagnetic and/or ferroelectric filler. The body (94) of lossy material is fused to the surfaces defining the chamber (92) in the electrical insulation housing (78) and to the electrodes (44) and (52).

8 Claims, 1 Drawing Sheet

PYROTECHNIC IGNITER WITH RADIO FREQUENCY FILTER

TECHNICAL FIELD

The present invention relates to an apparatus for inflating a vehicle occupant protection device and particularly relates to an electrically actuatable pyrotechnic igniter for an air bag inflator.

BACKGROUND OF THE INVENTION

An inflatable vehicle occupant protection device, such as an air bag, is inflated in the event of sudden vehicle deceleration such as occurs in a vehicle collision. The air bag restrains movement of a vehicle occupant during a vehicle collision. The air bag is inflated by inflation fluid from an inflator. The inflation fluid may be stored gas which is released from the inflator and/or gas generated by ignition of combustible gas generating material in the inflator. The inflator uses an electrically actuatable pyrotechnic igniter to open the container and release the stored gas and/or to ignite the gas generating material.

The electrically actuatable pyrotechnic igniter contains a charge of ignition material. The pyrotechnic igniter also contains a bridgewire that is supported in a heat transferring relationship with the ignition material. When the pyrotechnic igniter is actuated, an actuating level of electric current is directed through the bridgewire in the igniter. This causes the bridgewire to become resistively heated sufficiently to ignite the ignition material. The ignition material then produces combustion products that open the container and release the stored gas and/or ignite the gas generating material.

Radio frequency interference (RFI) suppression filters are commonly incorporated in an electrically actuatable pyrotechnic igniter. RFI suppression filters ensure that unwanted radio frequency (RF) signals are suppressed and allow the passage of direct current and low frequency alternating current. Failure to suppress RF signals might lead to the undesired actuation of the igniter.

In many cases, electrically actuatable pyrotechnic devices incorporating these RFI filters are also required to provide a gas-tight seal to protect sensitive components or materials contained within an enclosure. Many electrically actuatable pyrotechnic igniters incorporate a hermetically sealed chamber for their ignitable material that is vulnerable to degradation by the intrusion of water vapor.

SUMMARY OF THE INVENTION

The present invention is a pyrotechnic device. The pyrotechnic device comprises a body of ignitable material. A pair of electrodes provide electrical energy to heat and ignite the body of pyrotechnic material. The electrodes extend through an electrical insulation housing. The electrical insulation housing has surfaces defining a chamber through which the electrodes pass. A body of a solid electromagnetically lossy, substantially gas impermeable material is positioned within the chamber. The lossy material comprises a vitreous ceramic matrix consisting essentially of about 5% to about 50% by weight of a multi-component glass binder and about 50% to about 95% by weight of an electromagnetically lossy ferromagnetic and/or ferroelectric filler. The body of lossy material is fused to the surfaces defining the chamber in the electrical insulation housing and to the electrodes.

BRIEF DESCRIPTION OF THE DRAWINGS

The foregoing and other features of the invention will become more apparent to one skilled in the art upon consideration of the following description of the invention and the accompanying drawings in which.

DESCRIPTION OF PREFERRED EMBODIMENT

Figure 1:
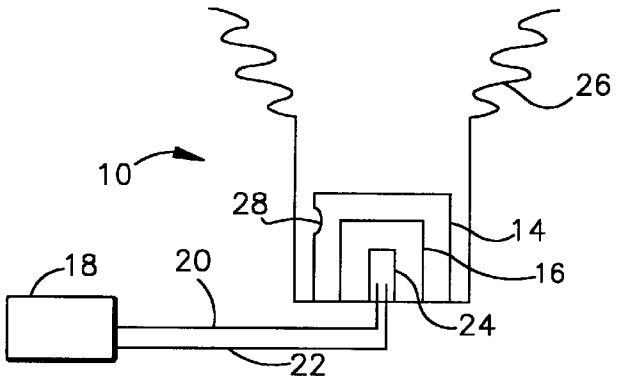
FIG. 1 is a schematic view of a vehicle occupant protection apparatus embodying the present invention.

Referring to FIG. 1, an apparatus 10 embodying the present invention includes an inflator 14 and an inflatable vehicle occupant protection device 26. The inflator 14 contains a gas generating material 16. The gas generating material 16 is ignited by an igniter 24 operatively associated with the gas generating material 16. Electric leads 20 and 22 convey electric current to and from the igniter 24. An electric current is conveyed to the igniter 24 through a crash sensor 18 from a power source (not shown). The crash sensor 18 acts as a switch in response to vehicle deceleration indicative of a vehicle collision. The current to the igniter 24 causes ignition of the gas generating material 16. A gas flow means 28, such as an opening in the inflator 14, conveys gas, which is generated by combustion of the gas generating material 16, to the vehicle occupant protection device 26.

A preferred vehicle occupant protection device 26 is an air bag, which is inflatable to help protect a vehicle occupant in the event of a vehicle collision. Other vehicle occupant protection devices which can be used with the present invention are inflatable seat belts, inflatable knee bolsters, inflatable air bags to operate knee bolsters, inflatable head liners, inflatable side curtains, and seat belt pretensioners.

Figure 2:
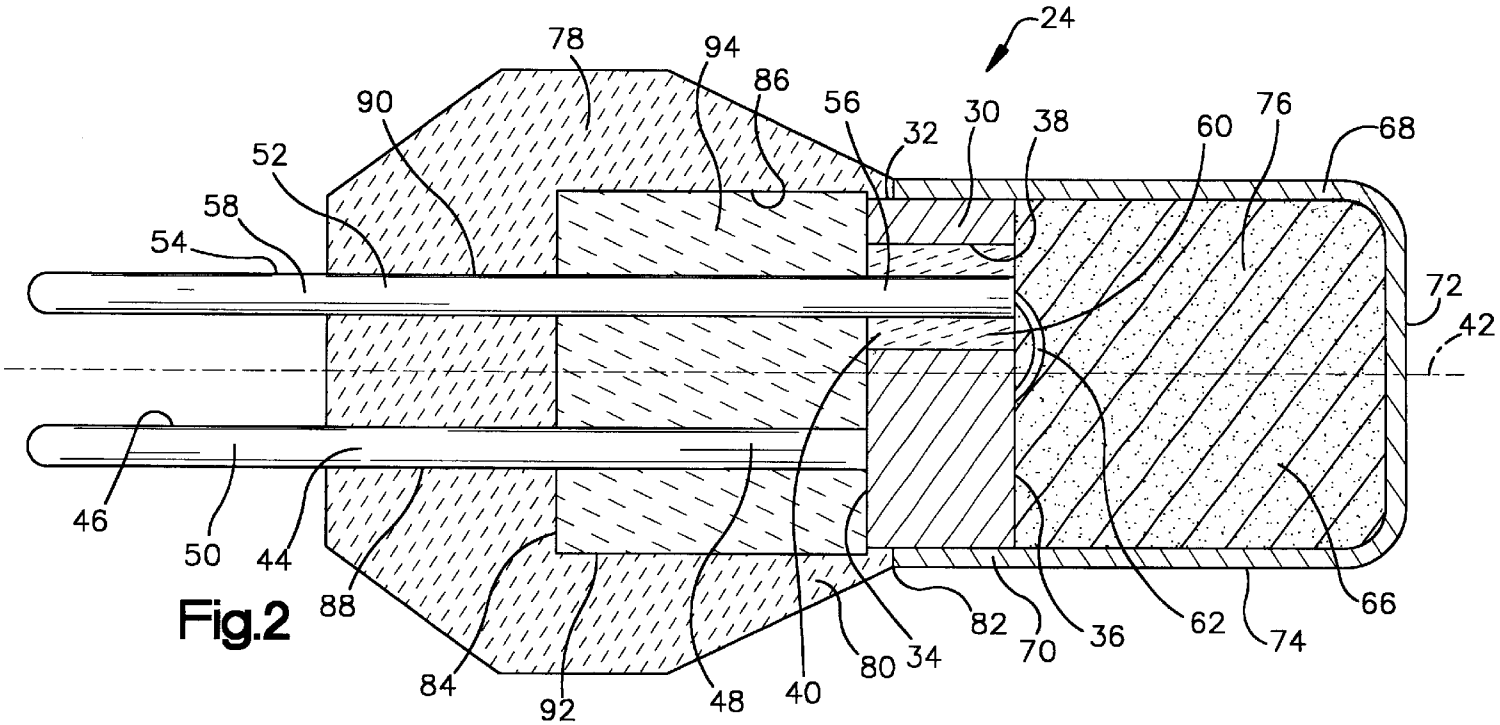
FIG. 2 is an enlarged sectional view of a part of the apparatus of FIG. 1.

Referring to FIG. 2, the igniter 24 includes a header 30. The header 30 is a generally cylindrical metal member preferably machined from 304L steel. The header 30 has a cylindrical outer surface 32 and flat, parallel, radially extending, circular opposite sides 34 and 36. A cylindrical opening 40 extends completely through the header 30 parallel to a central axis 42 of the igniter 24 and intersects the opposite sides 34 and 36 of the header 30.

A first electrode 44 is connected with the header 30. The first electrode 44 is made from a conductive wire material, such as drawn nickel iron alloy wire, and extends parallel to the central axis 42 of the igniter 24. The first electrode 44 has an inner end 48, which is brazed to the side 34 of the header 30, and an outer end 50, which extends away from the header 30 and protrudes, in the form of a prong 46, at one end of the igniter 24.

A second electrode 52 extends parallel to the first electrode 44. The second electrode 52 is made from the same material as the first electrode 44. The second electrode 52 has an inner end 56 which extends axially through the cylindrical opening 40 in the header 30. An outer end 58 of the second electrode 52 extends away from the opening 40 and forms a prong 54, similar to the prong 46 of the first electrode 44, at the one end of the igniter 24.

A bridgewire 62 extends between the inner end 56 of the second electrode 52 and the side 36 of the header 30. The bridgewire 62 is formed from a high resistance metal alloy. A preferred metal alloy is a nickel-chromium-iron alloy. Other suitable alloys for forming a high resistance bridgewire include platinum-tungsten and 304L steel. The bridgewire 62 heats up and generates thermal energy when an electrical current of predetermined magnitude passes through the bridgewire 62.

The bridgewire 62 extends through a portion of a pyrotechnic charge 66. The pyrotechnic charge 66 is a pyrotechnic material, which auto-ignites upon application of sufficient thermal energy. The pyrotechnic material can be any pyrotechnic material typically used in an igniter such as boron potassium nitrate ($BKNO_3$), potassium dinitrobenzofuroxan (KDNBF), barium styphnate monohydrate (BARSTY), cis-bis-(5-nitrotetrazolato)pentaaminecobalt (III)perchlorate (CP), diazidodinitrophenol (DDNP), 1,1-diamino-3,3,5,5-tetrazidocyclotriphosphazine (DATA), cyclotetramethylenetetranitramine (HMX), lead azide, and lead styphnate.

The pyrotechnic charge 66 is enclosed in an ignition cup 68. The ignition cup 68 is a cup-shaped metal member preferably made from drawn 304L stainless steel. The ignition cup 68 has a cylindrical wall 74, which defines a cavity 76 in which the pyrotechnic charge 66 is disposed. A portion 70 of the wall 74 of the ignition cup 68 overlies most of the cylindrical outer surface 32 of the header 30. The ignition cup 68 has a frangible end wall 72, which ruptures on ignition of the pyrotechnic charge 66.

The igniter 24 further includes a housing 78. The housing 78 is formed from an electrical insulation material. An electrical insulation material is a material that has a high resistance to the passage of current. Preferred electrical insulation materials are molded thermoplastics, such as nylon, and sintered ceramics, such as alumina or zirconia.

The housing 78 has a side wall 80, which extends parallel to the central axis 42 of the igniter between an open end 82 and a closed end 84 of the housing 78. The side wall 80 of the housing 78 has a cylindrical inner surface 86, which extends from the open end 82 of the housing 78 to the closed end 84. The cylindrical inner surface 86 and closed end 84 define a chamber 92. The closed end 84 of the housing 78 has parallel cylindrical passages 88 and 90 that extend parallel to the igniter axis 42 through the closed end 84 of the housing 78 and open into the chamber 92. The passages 88 and 90 receive the parallel electrodes 44 and 52, respectively.

The header 30 is seated within the open end 82 of the housing 78 so that the header 30 closes the open end 82, except for where the cylindrical opening 40 in the header 30 overlaps the open end 82.

A body 60 of gas impermeable glass is positioned in the cylindrical opening 40 of the header 30. The body 60 encircles the inner end 56 of the second electrode 52 and is encircled by a cylindrical inner surface 38 of the header 30 that defines the opening 40. The body 60 of gas impermeable glass is positioned in the opening 40, in a manner to be described, so that it fuses to and forms a gas-tight seal with the surface 38 and the inner end 56 of the second electrode 52. The body 60 of gas impermeable glass electrically insulates the header 30 from the inner end 56 of the second electrode 52.

A body 94 of electromagnetically lossy, substantially gas impermeable material is positioned within the chamber 92 of the housing 78. The body 94 of electromagnetically lossy, substantially gas impermeable material is fused to and forms a gas-tight electromagnetically lossy seal with the inner surfaces 84 and 86 of the housing and the side 34 of the header 30. The body 94 is also fused to and forms a gas-tight electromagnetically lossy seal with the portions of the first electrode 44 and the second electrode 52 that are encircled by the body 94. The body 94 of electromagnetically lossy, substantially gas impermeable material electrically insulates the first electrode 44 from the second electrode 52. Also, because it comprises an electromagnetically lossy filler, the body 94 provides RF attenuation for the igniter 24.

In accordance with the present invention, the body 94 of electromagnetically lossy substantially gas impermeable material comprise a dense vitreous ceramic matrix. The matrix consists essentially of a glass binder and a electromagnetically lossy ferromagnetic and/or ferroelectric filler interspersed through the binder. The amount of binder is about 5% to about 50% by weight of the matrix. The amount of filler is about 50% to about 95% by weight of the matrix.

Preferred glass binders are lead borosilicate and lead aluminoborosilicate glasses, which include oxides of Al, B, Ba, Mg, Sb, Si, and Zn. These binders are commercially available in the form of finely ground frits. Examples of binders are CORNING (Corning, N.Y.) high temperature sealing glasses nos. 1415, 8165, and 8445, CORNING low temperature ferrite sealing glasses nos.1416, 1417, 7567, 7570, and 8463, and FERRO CORPORATION (Cleveland, Ohio) low temperature display sealing glasses nos. EG4000 and EG4010.

Preferred ferromagnetic fillers include spinal structured ferrites having the general formula $(AaO)_{1-x}(BbO)_xFe_2O_3$ where Aa and Bb are divalent metal cations of Ba, Cd, Co, Cu, Fe, Mg, Mn, Ni, Sr, or Zn, and x is a fractional number in the semi-open interval [0,1). Examples of commercially available ferromagnetic fillers are FAIR-RITE PRODUCTS (Wallkill, N.Y.) nos. 73 and 43, which are sintered manganese-zinc and nickel-zinc spinal ferrite powders, respectively.

Preferred ferroelectric fillers include perovskite titanates having the general formula $(XxO)TiO_2$ and perovskite zirconates having the general formula $(XxO)ZrO_2$ where Xx denotes divalent metal cations of Ba, La, Sr, or Pb. Barium titanate, $(BaO)TiO_2$, is a typical species. Other acceptable fillers include electrically lossy La-modified lead zirconium titanate perovskite ceramics known as PLZTs.

The body 94 is formed by first preparing an electromagnetically lossy ceramic mixture of 5–50% by weight of the glass binder and 50–95% by weight of the lossy ferromagnetic and/or ferroelectric filler. The mixing is performed wet in a polyethylene ball mill using a ceramic media such alumina or zirconia and a volatile organic carrier such as acetone having a forming agent such as polyvinyl acetate and a fatty acid dispersant such as menhaden fish oil. The resulting mixture is then dried. The dried mixture can be used in either a free-flowing form or as a vitreous preform. A vitreous preform is prepared by pouring the dried mixture into a mold having the desired configuration and heating the mixture to an elevated temperature effective to coalesce the mixture into a solid body.

The following Examples illustrate use of the dried mixture and assembly of the igniter.

EXAMPLE 1

In this Example, the non-conductive housing 78 is made of a thermoplastic, such as nylon.

A graphite mold/fixture is provided that has in the mold portion of the mold/fixture the desired configuration of the body 94 of glass. The first and second electrodes, 44 and 52, and the header 30 are also positioned in the mold/fixture and held in fixed, preset desired positions in the mold/fixture. The dried mixture of electromagnetically lossy filler and glass binder is introduced into the mold/fixture as a vitreous preform. The vitreous preform fills the mold and encircles the electrodes 44 and 52. A glass preform is introduced into the opening 40. The glass preform fills the opening 40 and encircles the inner end 56 of the electrode 52. The graphite mold/fixture, the mixture of electromagnetically lossy filler and glass binder, the glass preform, the electrodes 44 and 52, and the header 30 are heated to a temperature above the glass working temperature of the glass binder and the glass preform (i.e. about 580° C. to about 800° C.). At this temperature, the electromagnetically lossy filler and glass binder as well as the glass preform soften or melt, wetting the surfaces of the electrodes 44 and 52 and the header 30 in contact with the electromagnetically lossy filler and binder and the glass preform. Upon cooling, the glass preform solidifies into the gas impermeable glass body 60, and the electromagnetically lossy filler and binder coalesce into the electromagnetically lossy, substantially gas impermeable body 94. The surfaces of the body 60 are chemically bonded to and form a gas-tight seal with the surface 38 of the header 30 and inner end 56 of the second electrode, which are contacted by the body 60. The surfaces of the body 94 are chemically bonded to and form a gas-tight electromagnetically lossy seal with the surfaces of the electrodes 44 and 52 and the header 30 that are contacted by the body 94.

The bridgewire 62 is welded to the inner end 56 of the second electrode 52 and the side 36 of the header. The pyrotechnic charge 66 is placed in the ignition cup 68. The ignition cup 68 is attached to the header 30 so that the pyrotechnic charge 66 is in contact with the bridgewire 62 and the wall of the ignition cup overlies most of the outer surface 32 of the header 30.

The graphite fixture is then removed and the electrodes 44 and 52, the header 30, the body 64 and the body 90 are placed in a second mold having a cavity shaped to the shape of the housing 78. The material of the thermoplastic housing 78 is heated and flowed into the mold cavity around the now solid body 94 so that electrodes extend through the cylindrical passages 88 and 90 in the closed end 84 of the housing 78. Upon cooling, the thermoplastic housing 78 becomes bonded to and forms a gas-tight electromagnetically lossy seal with the body 94 of electromagnetically lossy, substantially gas impermeable material, the ends 50 and 58 of the electrodes 44 and 52, and the header 30. The second mold is then removed from the housing.

EXAMPLE 2

This Example illustrates use of the dried mixture of glass binder and electromagnetically lossy filler when the housing 78 is made of a sintered ceramic such as alumina.

The vitreous preform of binder and electromagnetically lossy filler is seated in the housing 78. The electrodes 44 and 52 and the header 30 are placed in the housing 78 so that the electrodes 44 and 52 extend through the cylindrical passages 88 and 90 in the closed end 84 of the housing 78. A glass preform is seated in the opening 40 of the header 30 so that the inner end 56 of the second electrode 52 extends through the opening 40. The housing 78, the mixture of electromagnetically lossy filler and binder, the glass preform, the electrodes 44 and 52, and the header 30 are heated to a temperature above the glass working temperature of the glass binder and the glass preform (i.e. about 580° C. to about 800° C.). At this temperature, the housing 78 retains its shape. Also, at this temperature, the electromagnetically lossy filler and glass binder as well as the glass preform soften or melt, wetting the surfaces of the housing 78, electrodes 44 and 52, and the header 30 in contact with the electromagnetically lossy filler and binder and the glass preform. Upon cooling, the glass preform solidifies into the gas impermeable glass body 60, and the electromagnetically lossy filler and binder coalesce into the electromagnetically lossy substantially, gas impermeable body 94. The surfaces of the body 60 of gas impermeable glass are chemically bonded to and form a gas-tight seal with the surface 38 of the header 30 and inner end 56 of the second electrode, which are contacted by the body 60. The surfaces of the body 94 are chemically bonded to and form a gas-tight electromagnetically lossy seal with the surfaces of the housing 78, electrodes 44 and 52, and header 30 that are contacted by the second body 94.

The bridgewire 62 is welded to the inner end 56 of the second electrode 52 and the side 36 of the header. The pyrotechnic charge 66 is placed in the ignition cup 68. The ignition cup 68 is attached to the header 30 so that the pyrotechnic charge 66 is in contact with the bridgewire 62 and the wall of the ignition cup overlies most of the outer surface 32 of the header 30.

From the above description of the invention, those skilled in the art will perceive improvements, changes and modifications. Such improvements, changes and modifications within the skill of the art are intended to be covered by the appended claims.

Having described the invention, the following is claimed:

1. A pyrotechnic device comprising:

a body of ignitable pyrotechnic material;

a pair of electrodes for providing electrical energy to heat and ignite the body of pyrotechnic material;

an electrical insulation housing through which the electrodes extend, the electrical insulation housing comprising a molded thermoplastic and having surfaces defining a chamber through which the electrodes pass;

a body of a solid electromagnetically lossy substantially gas impermeable material in the chamber, the lossy material comprising a vitreous ceramic matrix consisting essentially of (a) about 5–50% by weight of a multi-component glass binder and (b) about 50–95% by weight of a electromagnetically lossy ferromagnetic and/or ferroelectric filler interspersed throughout;

the body of lossy material forming a gas-tight seal with the surfaces defining the chamber and the electrodes.

2. The pyrotechnic igniter of claim 1, wherein the binder is lead borosilicate glass.

3. The pyrotechnic igniter of claim 1, wherein the binder is lead aluminoborosilicate glass.

4. The pyrotechnic igniter of claim 1, wherein the lossy ferromagnetic filler comprises a spinal ferrite having the general formula $(AaO)_{1-x}(BbO)_xFe_2O_3$ where Aa and Bb are divalent metal cations of Ba, Cd, Co, Cu, Fe, Mg, Mn, Ni, Sr, or Zn, and x is a fractional number in the semi-open interval [0,1).

5. The pyrotechnic igniter of claim 1, wherein the lossy ferroelectric filler is selected from the group consisting of perovskite titanates having the general formula $(XxO)TiO_2$ and perovskite zirconates having the general formula $(XxO)ZrO_2$ where Xx denotes divalent metal cations of Ba, La, Sr, or Pb.

6. The pyrotechnic igniter of claim 1, wherein the lossy ferroelectric filler comprises a La-modified lead zirconium titanate perovskite ceramic.

7. A method of making a pyrotechnic igniter comprising the following steps:

providing a body of a solid electromagnetically lossy substantially gas impermeable material, the lossy material comprising a vitreous ceramic matrix consisting essentially of (a) about 5–50% by weight of a multi-component glass binder and (b) about 50–95% by weight of a electromagnetically lossy ferromagnetic and/or ferroelectric filler interspersed throughout;

extending a pair of electrodes through the body of lossy material, the electrodes providing electrical energy to heat and ignite a body of pyrotechnic material;

forming a gas-tight seal with the body of lossy material and the electrodes;

molding a thermoplastic material around the body of lossy material, a gas-tight seal being formed between the molded thermoplastic material and the body of lossy material; and positioning the body of pyrotechnic material in heat transferring relationship with the electrodes.

8. A pyrotechnic device comprising:

a body of ignitable pyrotechnic material;

a pair of electrodes for providing electrical energy to heat and ignite the body of pyrotechnic material;

an electrical insulation housing through which the electrodes extend, the electrical insulation housing comprising a molded thermoplastic and having a sidewall with a cylindrical surface defining a chamber through which the electrodes pass;

a body of a solid electromagnetically lossy substantially gas impermeable material in the chamber, the lossy material comprising a vitreous ceramic matrix consisting essentially of (a) about 5–50% by weight of a multi-component glass binder and (b) about 50–95% by weight of a electromagnetically lossy ferromagnetic and/or ferroelectric filler interspersed throughout; and the body of lossy material forming a gas-tight seal with the cylindrical surface defining the chamber in the electrical insulation housing and the electrodes.

* * * * *